US007605769B2

(12) United States Patent
Lee et al.

(10) Patent No.: US 7,605,769 B2
(45) Date of Patent: Oct. 20, 2009

(54) MULTI-BAN U-SLOT ANTENNA

(75) Inventors: Jae Chan Lee, Gyunggi-Do (KR); Jong Won Yu, Daejeon (KR); Wang Sang Lee, Daejeon (KR); Hyun Hak Kim, Gyunggi-Do (KR)

(73) Assignee: Samsung Electro-Mechanics Co., Ltd., Suwon, Gyunggi-Do (KR)

( * ) Notice: Subject to any disclaimer, the term of this patent is extended or adjusted under 35 U.S.C. 154(b) by 106 days.

(21) Appl. No.: 11/735,868

(22) Filed: Apr. 16, 2007

(65) Prior Publication Data

US 2007/0247386 A1 Oct. 25, 2007

(30) Foreign Application Priority Data

Apr. 19, 2006 (KR) ..... 10-2006-0035340

(51) Int. Cl.
*H01Q 13/10* (2006.01)
*H01Q 15/24* (2006.01)

(52) U.S. Cl. ..... 343/770; 343/767; 343/846; 343/909

(58) Field of Classification Search ..... 343/700 MS, 343/770, 767, 846, 909
See application file for complete search history.

(56) References Cited

U.S. PATENT DOCUMENTS 5,914,693 A * 6/1999 Takei et al. ..... 343/767
6,133,879 A * 10/2000 Grangeat et al. ..... 343/700 MS
6,160,515 A * 12/2000 McCoy et al. ..... 343/702
6,188,369 B1 * 2/2001 Okabe et al. ..... 343/767
6,496,148 B2 * 12/2002 Ngounou Kouam et al. ..... 343/700 MS
2004/0085244 A1 * 5/2004 Kadambi et al. ..... 343/700 MS

FOREIGN PATENT DOCUMENTS

WO WO 2006042562 A1 * 4/2006

OTHER PUBLICATIONS

Elsadek, Hala, "Multiband Miniaturized PIFA for Compact Wireless-Communication Apparatus" Microwave and Optical Technology Letters, vol. 42, No. 3, Aug. 5, 2004.*
Rosa, Jose, "Dual-Band Microstrip Patch Antenna Element with Double U Slots for GSM," IEEE, 2000.*
Tangitjesada, "U-Shaped Slot Antenna for Triple-Frequency," Communications, Circuits, and Systems Proceedings, 2006 International Conferences on, vol. 2, p. 1434-1437, Jun. 25-28, 2006.*
Eun Sil Oh et a., "Wideband Microstrip Antenna with the Double U-slots".
Moon-kyou Kang et al., "Fabrication and Measurement of Triple U-shaped slot Microstrip Antenna in 5GHz band".
Korean Intellectual Property Office, Office Action mailed Mar. 26, 2007 and English Translation thereof.

* cited by examiner

*Primary Examiner*—Douglas W Owens
*Assistant Examiner*—Jennifer F Hu
(74) *Attorney, Agent, or Firm*—Lowe Hauptman Ham & Berner

(57) ABSTRACT

In a multi-band U-slot planar antenna, a limited ground plane is provided. A connector includes a ground terminal connected to the ground plane and a feeding terminal for feeding a signal. A planar radiation device includes a feeding point connected to the feeding terminal, a central U-slot having a symmetrical configuration about a central axis thereof, the central axis extending vertically from the feeding point, and at least one pair of auxiliary U-slots symmetrical with each other about the central axis. In the multi-band U-slot planar antenna, alternatively, at least one auxiliary U-slot may have a symmetrical configuration about the central axis.

4 Claims, 8 Drawing Sheets

MULTI-BAN U-SLOT ANTENNA

CLAIM OF PRIORITY

This application claims the benefit of Korean Patent Application No. 2006-35340 filed on Apr. 19, 2006 in the Korean Intellectual Property Office, the disclosure of which is incorporated herein by reference.

BACKGROUND OF THE INVENTION

1. Field of the Invention

The present invention relates to a multi-band U-slot antenna, more particularly, which has a plurality of frequency notch filters to operate in a multi-band frequency as a single antenna.

2. Description of the Related Art

With a variety of systems incorporated together lately, an antenna has been required to possess higher capabilities. The antenna needs to function not only in a single narrow frequency band but also in a multiple narrow frequency band or a broad frequency band. Thus, the antenna should be designed to achieve multi-band performance. The multi-band can be attained by two methods of combining narrow bands together or embedding a frequency notch filter in a broad band. The former entails a complicated design and a time-consuming tuning caused by undesired results from design or during manufacturing. Therefore, recently, the latter has gained a spotlight. That is, a slot functioning as a notch filter has been inserted into a broadband antenna. This method involves simple designing and does not require a separate tuning after manufacturing, thereby simplifying a process.

FIG. 1 is a perspective view illustrating a conventional planar antenna with a single U-slot.

As shown, a single U-slot microstrip patch antenna has a U-slot 13 formed in a patch 12. Although not illustrated, a dielectric body 12 and a ground substrate are stacked sequentially under the patch 12. Also, a coaxial line extends through the ground substrate and the dielectric body 11 onto the patch 12.

The U-slot located adjacent to radiating edges of the patch 12 disturbs distribution of current which generates fundamental resonance mode, thereby generating another resonance in its near-by frequency. This resonance characteristic, in combination with resonance of a square microstrip patch, beneficially assures dual resonance characteristics. That is, primary resonance is generated by the microstrip patch 12 and secondary resonance is generated by the U-slot 13. In FIG. 1, □+□+□ indicate a length of a current path where the primary resonance occurs and □+□+□+□+□ indicate a length of the current path where the secondary resonance occurs.

The two resonance frequencies, when spaced apart from each other, realize a dual resonance antenna, i.e., with a single notch filter. Meanwhile, the resonance frequencies, when located substantially identically, provide a broadband antenna. In general, the dual resonance antenna exhibits a big loop and a small loop on an impedance trajectory of a smith chart. Notably, position and size of the small loop within the big loop determines a bandwidth of impedance of the antenna. Parameters for varying the small loop on the smith chart include width and length of a square patch (bottom of the U-slot), length and shape of the U-slot, thickness and relative permittivity of the substrate.

Conventionally, attention was drawn only to a single notch filter, which was thus embedded in an antenna to achieve multi-band performance. However, little consideration was given to a method for embedding the notch filter to implement dual or more bands. The conventional single notch filter, when adopted for such multi band performance, is accompanied by great problems.

SUMMARY OF THE INVENTION

The present invention has been made to solve the foregoing problems of the prior art and therefore an aspect of the present invention is to provide a planar monopole antenna which has a plurality of U-slots with a symmetrical configuration disposed in a radiation device to act as a plurality of notch filters, thereby operating in a multi-band frequency.

According to an aspect of the invention, the multi-band U-slot planar antenna includes a limited ground plane; a connector having a ground terminal connected to the ground plane and a feeding terminal for feeding a signal; and a planar radiation device including a feeding point connected to the feeding terminal, a central U-slot having a symmetrical configuration about a central axis thereof, the central axis extending vertically from the feeding point, and at least one pair of auxiliary U-slots symmetrical with each other about the central axis.

The auxiliary U-slots comprise a pair of U-slots to act as a double notch filter. Alternatively, the auxiliary U-slots comprise two pairs of U-slots to act as a triple notch filter According to an aspect of the invention, the multi-band U-slot planar antenna includes a limited ground plane; a connector having a ground terminal connected to the ground plane and a feeding terminal for feeding a signal; and a planar radiation device including a feeding point connected to the feeding terminal, a central U-slot having a symmetrical configuration about a central axis thereof, the central axis extending vertically from the feeding point, and at least one auxiliary U-slot having a symmetrical configuration about the central axis.

The auxiliary U-slot comprises one U-slot to act as a double notch filter.

The auxiliary U-slot has a central point located identical to that of the central U-slot.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings. Here, a plurality of U-slots may be configured and arranged variously.

Figure 1:
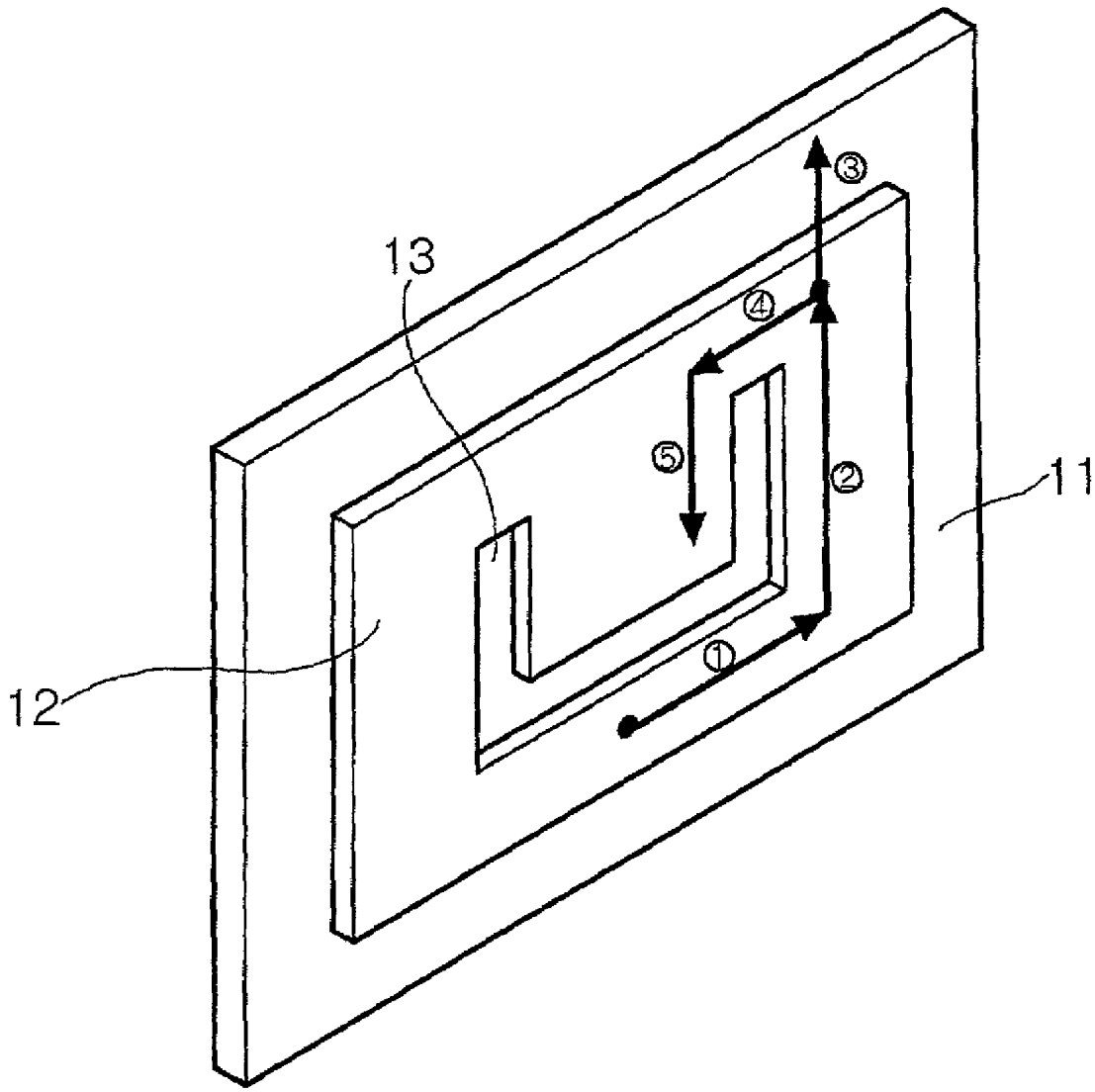
Prior art FIG. 1
FIG. 1 is a perspective view illustrating a single band U-slot antenna according to the prior art.
Figure 2:
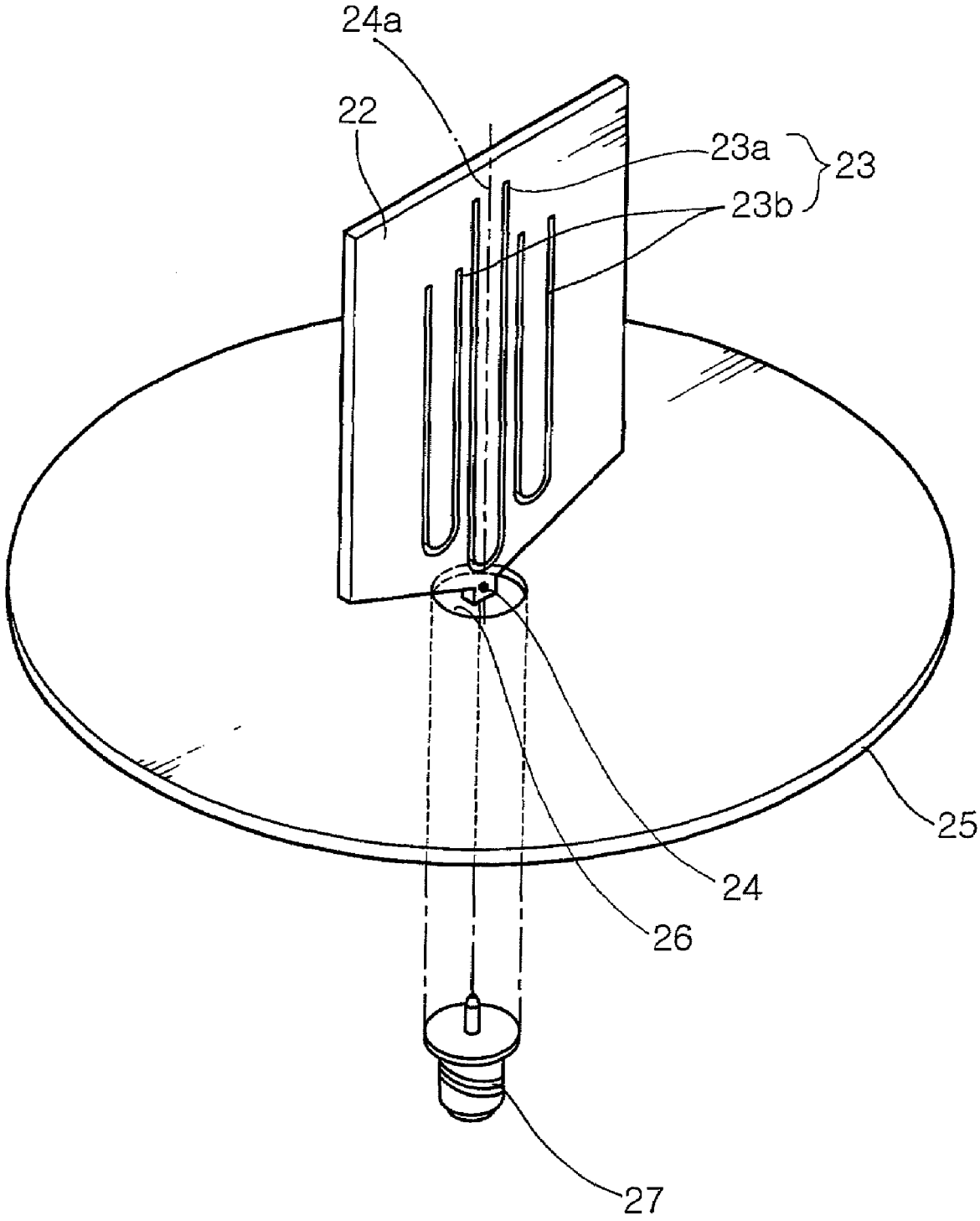
FIG. 2 is a perspective view illustrating a multi-band U-slot antenna according to an embodiment of the invention.

FIG. 2 is a perspective view illustrating a multi-band U-slot planar antenna according to an embodiment of the invention.

Referring to FIG. 2, the antenna of the invention includes a limited ground plane 25 and a radiation device 22 disposed perpendicular to the ground plane 25 and connected to a feeding terminal by a connector 27.

A through hole 26 is perforated in a central portion of the limited ground plane 25 to connect a feeding point 24 of the radiation device 22 to the feeding terminal of the connector 27.

Preferably, the feeding point 24 is centered in a side portion of the planar radiation device 22.

A plurality of U-slots 23 are formed in the radiation device 22. Here, current flows in opposite directions inside and outside of the U-slots 23. If a total length of the U-slots corresponds to a half wavelength of a notch central frequency, the frequency has a return loss of almost 0 dB. Thus, the notch central frequency is determined by adjusting the length of the U-slots.

The U-slots 23 formed in a planar surface of the radiation device 22 are preferably arranged to be vertically symmetrical with each other about a central axis, which is an extended line 24*a* of the feeding point 24. This ensures the U-slots 23 to act as a notch filter with superior characteristics. Surely, the U-slots, with either a symmetrical or asymmetrical configuration, can function as a notch filter. However, the symmetrical configuration allows the notch filter to achieve better blocking characteristics. Moreover, a notch frequency band is decided by the width of the U-slots.

In FIG. 2, the length and width of U-slots are not limited but variously modified according to a desired notch central frequency and a notch frequency band.

In FIG. 2, a central U-slot 23*a* is formed in a central area of a planar surface of the radiation device along the central axis which is the extended line 24*a* of the feeding point. The central U-slot 23*a* has a central point located on the extended line 24*a* of the feeding point. Also, the central U-slot 23*a* is formed in a forward direction to have an opening located opposite to the feeding point 24. Moreover, a pair of auxiliary U-slots 23*b* are formed in a forward direction to be symmetrical with each other. The auxiliary U-slots 23*b* are disposed to oppose each other about the U-slot 23*a*.

The central U-slot 23*a* has a symmetrical configuration about the extended line 24*a* of the feeding point. The auxiliary U-slots 23*b* are symmetrical with each other about the extended line 24*a* of the feeding point.

Such a configuration leads to change in a length of a current path where current flows, thereby altering a wavelength that generates resonance. In FIG. 2, a current path of the auxiliary U-slots 23*a* differs in length from a current path of both the auxiliary U-slots 23*a* and 23*b* and the central U-slot 23*a*. This arrangement allows the U-slots 23 to function as a double notch filter, thereby operating in a triple band frequency.

The connector 27 is configured as a coaxial cable with an internal terminal acting as a feeding terminal to feed a signal to the radiation device, and connected to the feeding point 24 of the radiation device. An external terminal is connected to the ground plane 25.

Figure 3:
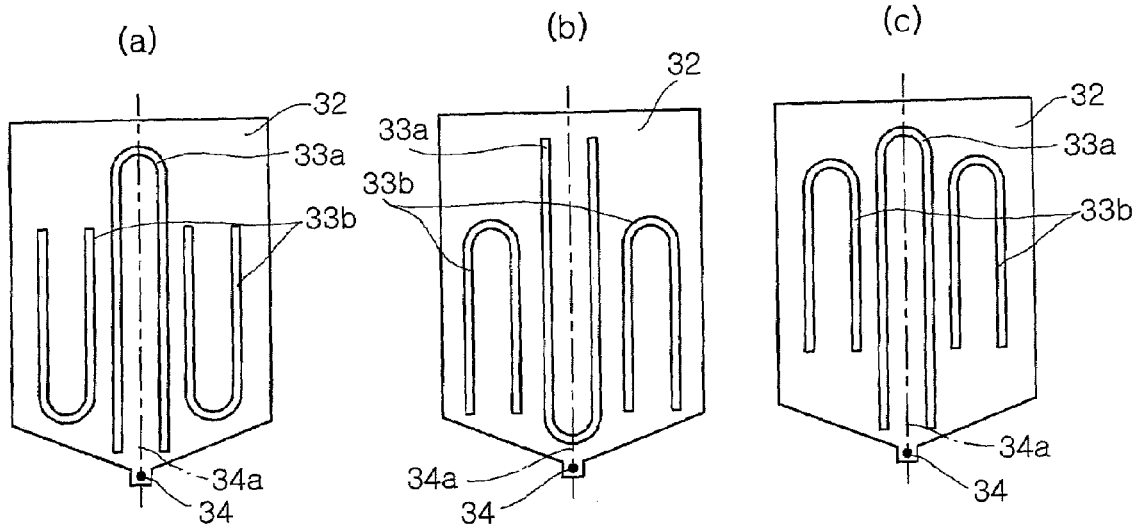
FIG. 3 is a front elevation view illustrating arrangement of U-slots which act as a double notch filter according to another embodiment of the invention.

FIGS. 3*a* to 3*c* illustrate an embodiment of the invention in which a central slot is formed in a central area of a radiation device and a pair of auxiliary U-slots are disposed at both sides about the central U-slot, as shown in FIG. 2.

Referring to FIG. 3*a*, a central U-slot 33*a* is formed in an inverse direction in a central area of the radiation device 32 and a pair of auxiliary U-slots 33*b* are formed in a forward direction to oppose each other about the central U-slot 33*a*.

The central U-slot 33*a* has a central point located on an extended line 34*a* of the feeding point of the radiation device, and has a symmetrical configuration about the extended line 34*a*.

The central U-slot 33*a* is formed in an inverse direction so as to have an opening located adjacent to the feeding point.

The auxiliary U-slots 33*b* are formed in a forward direction at both sides about the central U-slot 33*a*. Preferably, the auxiliary U-slots 33*b* are symmetrical with each other about a central axis, i.e., the extended line 34*a* of the feeding point.

As described above, the U-slots have two pairs of symmetrical slot configurations about the extended line 34*a* of the feeding point of the radiation device, thereby enabling an antenna with two notch filters, i.e., a triple band antenna.

Referring to FIG. 3*b*, the central U-slot 33*a* is formed in a forward direction in such a fashion that a central point of the U-slot is located on the extended line 34*a* of the feeding point. The central U-slot 33*a* is formed in a forward direction so as to have an opening located opposite to the feeding point. The auxiliary U-slots 33*b* are formed in an inverse direction at both sides about the central U-slot 33*a*, respectively, to produce an antenna with two notch filters.

In FIG. 3*c*, the central U-slot 33*a* is formed in an inverse direction in such a fashion that a central point of the U-slot is located on the extended line 34*a* of the feeding point of the radiation device. Also, the auxiliary U-slots 33*b* are formed in an inverse direction at both sides about the central U-slot 33*a*, respectively, to obtain an antenna with double notch filters.

FIGS. 7*a* to 7*d* are graphs illustrating return losses of the antennas having the U-slots shown in FIG. 2 and FIGS. 3*a* to 3*c*.

Referring to the graphs, frequency and return loss vary depending on arrangement of the U-slots, but the type of a notch filter is determined by the number of the slots which are symmetrical about the extended line of the feeding point.

Therefore, at a return loss of 10 dB, notch characteristics are plotted at frequencies of 3 GHz and 5 GHz, thereby producing three frequency bandwidths.

Figure 4:
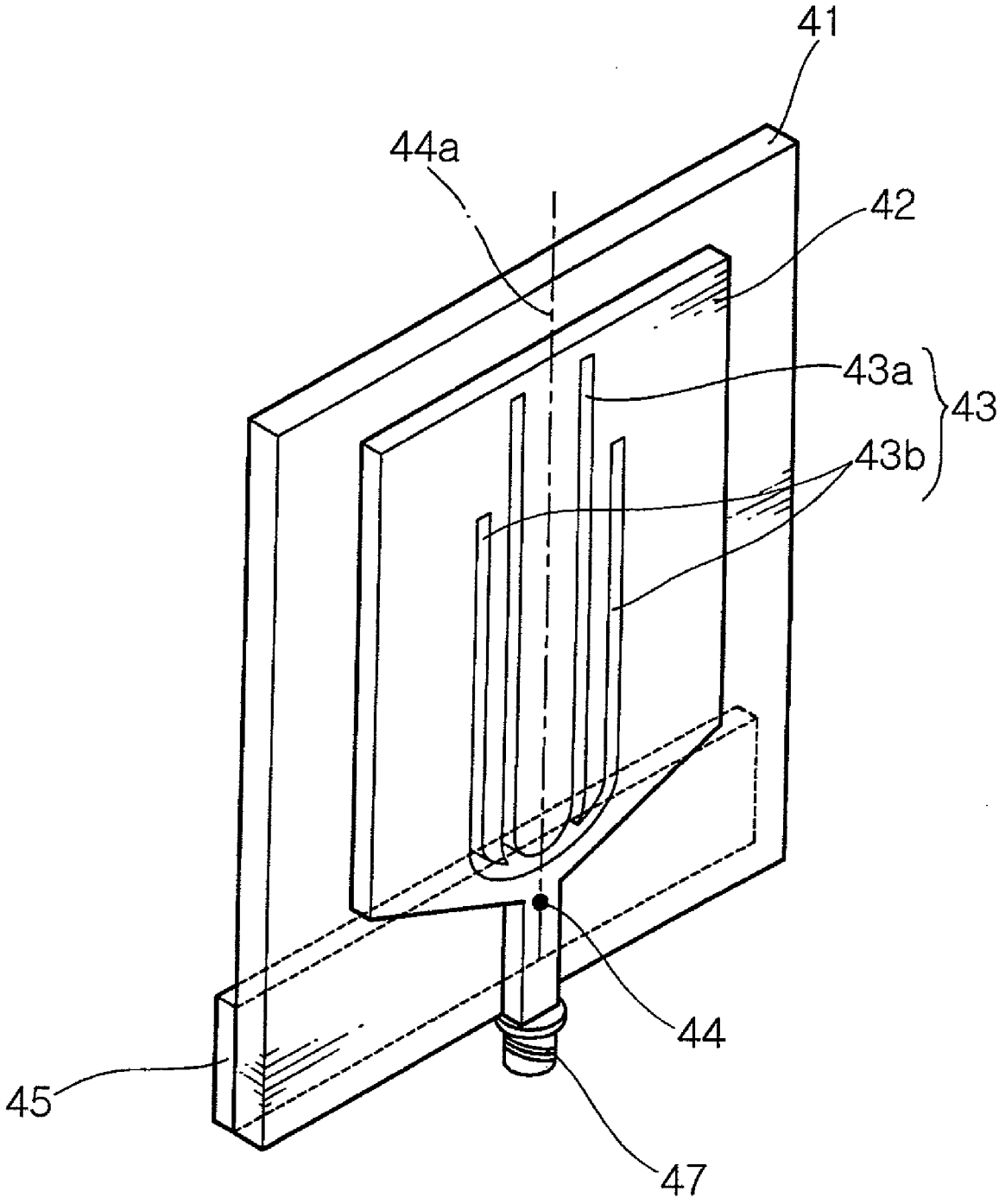
FIG. 4 is a perspective view illustrating a multi-band U-slot antenna according to further another embodiment of the invention.

FIG. 4 is a perspective view illustrating a planar antenna with a microstrip feeding structure according to another embodiment of the invention.

Referring to FIG. 4, the antenna of the invention includes a ground plate 45, a dielectric substrate 41 formed on the ground plate 45, a radiation device 42 disposed on the dielectric substrate 41, a feeding terminal for feeding a signal to the radiation device and a connector 47 having a ground terminal connected to the ground plate 45.

Here, the ground plate is a metal layer for grounding.

The dielectric substrate 41 is interposed between the ground plate 45 and the radiation device 42 to provide uniform medium between the ground plate 45 and the radiation device 42 so that a signal is stored, and transmitted to an electromagnetic wave field.

Referring to FIG. 4, one central U-slot 43*a* is formed in a central area of a planar surface of the radiation device 42 along a central axis, i.e., the extended line 44*a* of the feeding point. The central U-slot 43*a* has a central point located on the extended line 44*a* of the feeding point. The central U-slot 43*a* is formed in a forward direction so as to have an opening located opposite to the feeding point 44. Moreover, an auxiliary U-slot 43*b* is formed in a forward direction to surround the central U-slot 43*a*. The auxiliary U-slot 43*b* is formed lower than the central U-slot 43*a* and has a central point located identical to that of the central U-slot 43*a*. Here, the auxiliary U-slot 43*b* has a symmetrical configuration about the extended line 44*a* of the feeding point.

The central U-slot 43*a* and the auxiliary U-slot 43*b* have a vertically symmetrical configuration about the central line, i.e., the extended line 44*a* of the feeding point. Also, as described above, the central U-slot 43*a* has a central point identical to that of the auxiliary U-slot 43*b*.

In this arrangement, the U-slots have two pairs of symmetrical configurations about the central axis to act as a double notch filter, thereby operating in a triple frequency.

Figure 5:
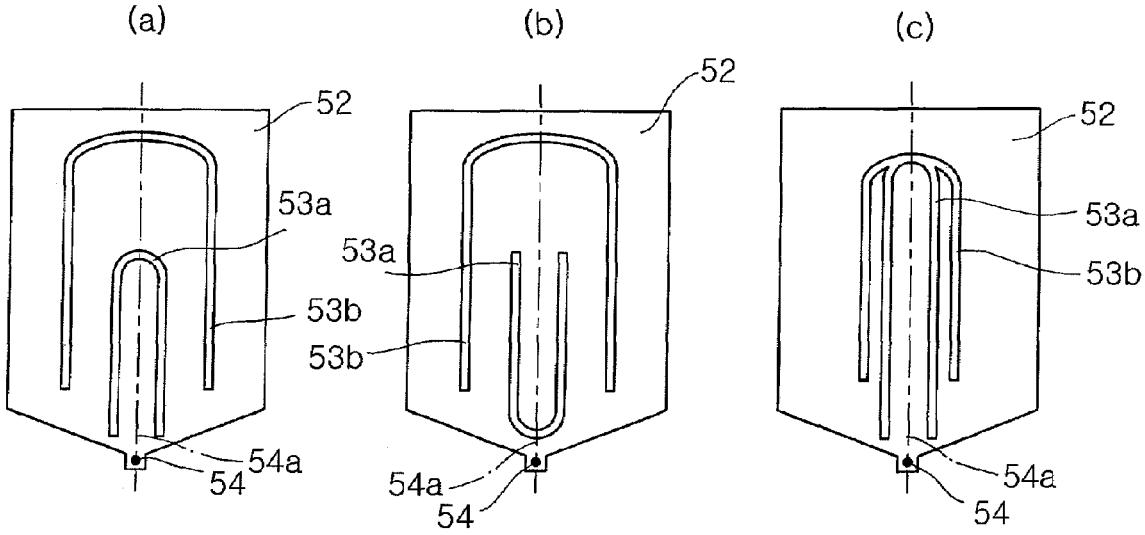
FIG. 5 is a front elevation view illustrating arrangement of U-slots which act as a double notch filter according to further another embodiment of the invention.

FIGS. 5*a* to 5*c* illustrate an embodiment of the invention in which a central U-slot is formed in a central area of a radiation device, as shown in FIG. 4 and an auxiliary U-slot is disposed to surround the central U-slot from above.

Referring to FIG. 5*a*, a central U-slot 53*a* is formed in an inverse direction in a central area of the radiation device 52. Also, an auxiliary U-slot 53*b* is disposed in an inverse direction to surround the central U-slot 53*a* from above.

The central U-slot 53*a* has a central point located on an extended line 54 of the feeding point of the radiation device, and is vertically symmetrical about the extended line 54*a*.

The auxiliary U-slot 53*b* also has a central point located on the extended line 54*a* of the feeding point of the radiation device, and is vertically symmetrical about the extended line 54*a*.

As described above, the U-slots have two pairs of symmetrical slot configurations about the central axis, i.e., the extended line 54*a* of the feeding point of the radiation device, thereby producing an antenna with double notch filters, i.e., an antenna with triple bandwidths.

Referring to FIG. 5*b*, the central U-slot 53*a* is formed in a forward direction in such a fashion that a central point of the U-slot is located on the extended line 54*a* of the feeding point of the radiation device 52. Also, the auxiliary U-slot 53*b* is disposed in an inverse direction to surround the central U-slot 53*a* from above, thereby producing an antenna with double notch filters.

Referring to FIG. 5*c*, the central U-slot 53*a* is formed in an inverse direction in such a fashion that a central point of the U-slot is placed on the extended line 54*a* of the feeding point of the radiation device. Also, the auxiliary U-slot 53*b* is disposed in an inverse direction to surround the central U-slot 53*a*. The auxiliary U-slot 53*b* is formed shorter than the central U-slot 53*a* and has a central point identical to that of the central U-slot 53*a*

Figure 7:
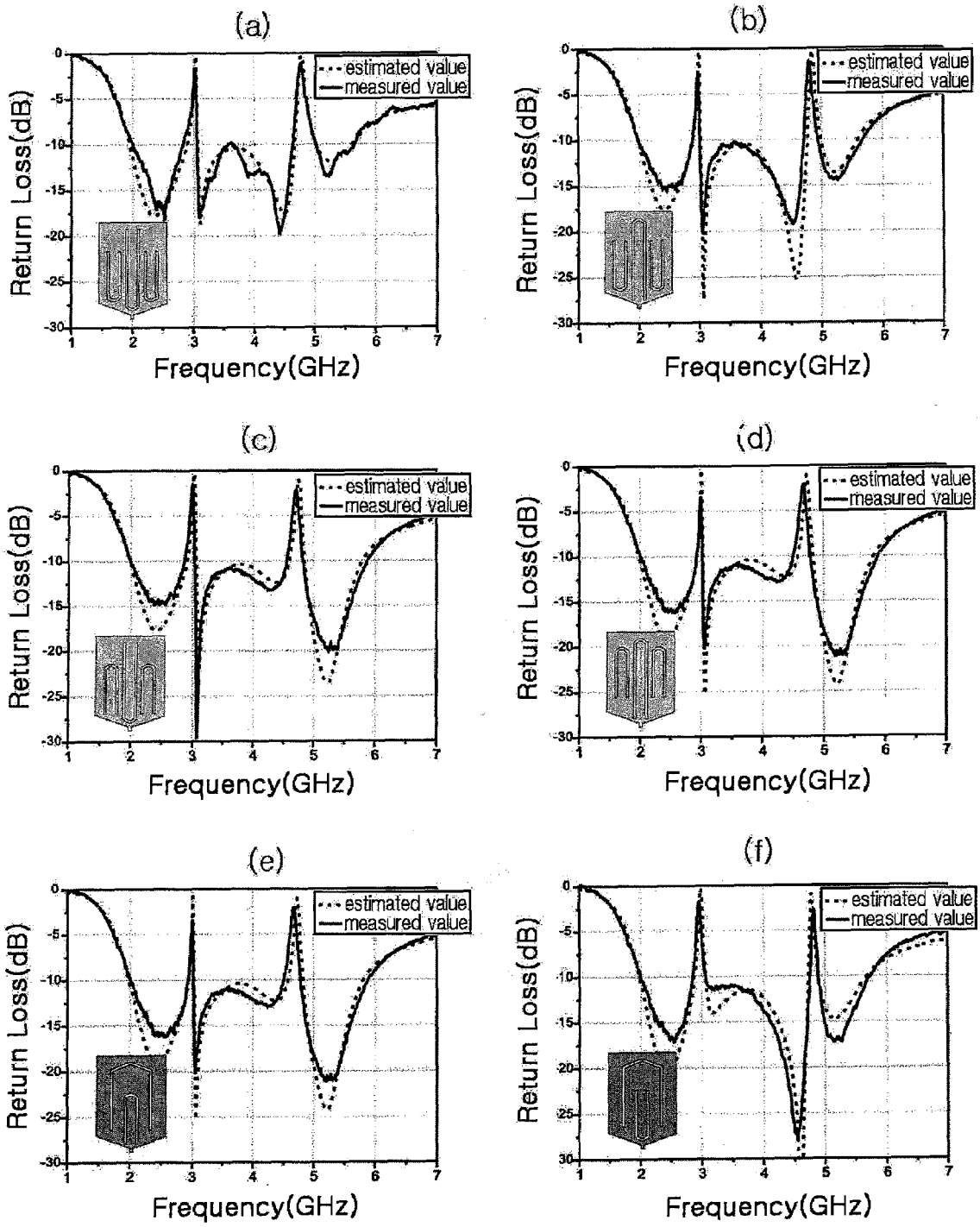
FIG. 7 is a graph illustrating return loss of a dual notch filter according to the invention.

FIGS. 7*e* and 7*f* are graphs illustrating return losses of the antennas shown in FIGS. 5*a* to 5*c*.

Referring to the graphs, frequency and return loss vary depending on arrangement of the U-slots, but the type of a notch filter is determined by the number of the U-slots which are symmetrical about the central axis, i.e., the extended line of the radiation device.

Therefore, at a return loss of 10 dB, notch characteristics are plotted at frequencies of 3 GHz and 5 GHz, thereby producing three frequency bandwidths.

FIGS. 6*a* to 6*h* are front elevation views illustrating various arrangements of U-slots to act as a triple notch filter according to further another embodiment of the invention.

Figure 6:
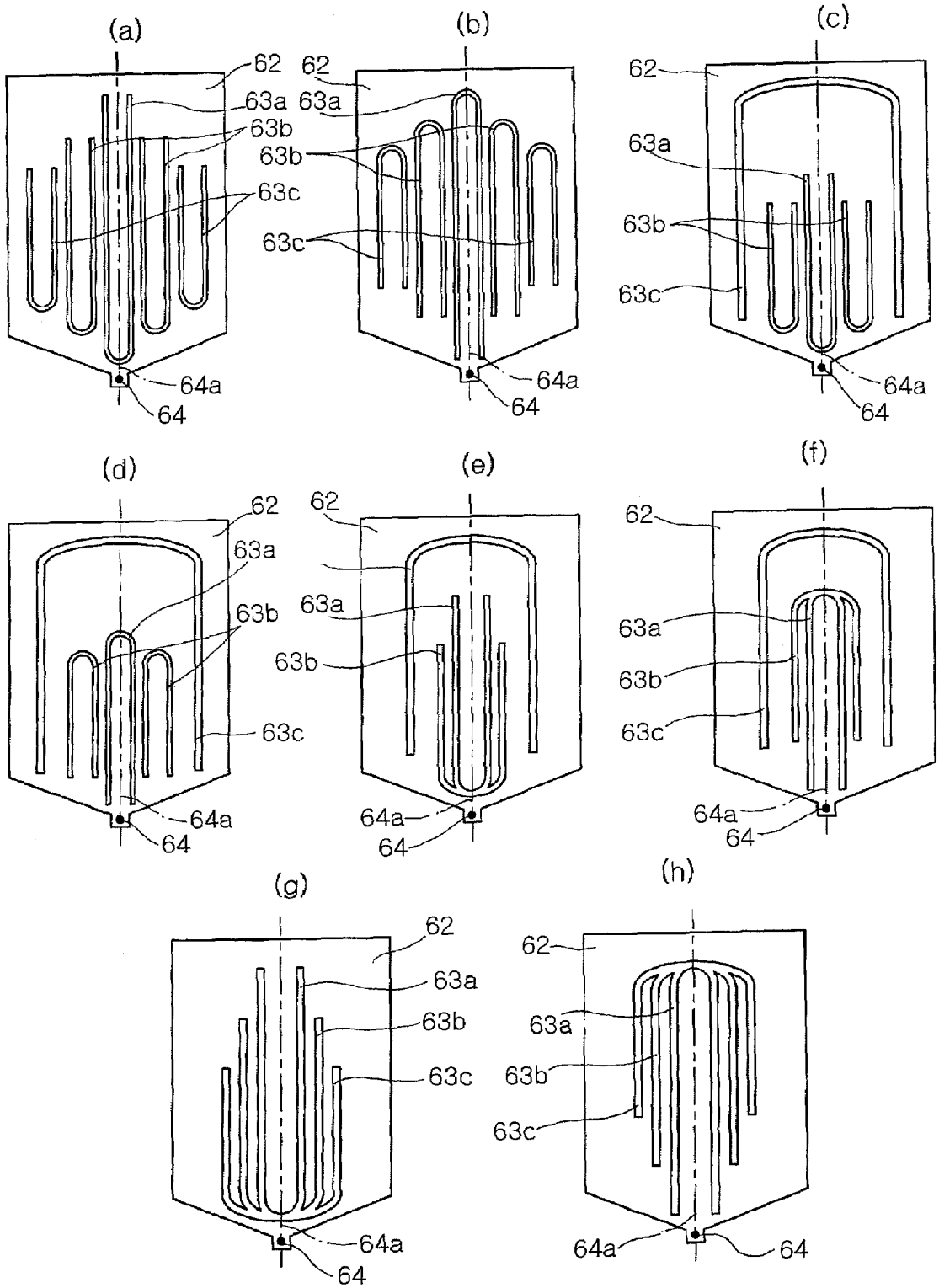
FIG. 6 is a front elevation view illustrating arrangement of U-slots which act as a triple notch filter according to further another embodiment of the invention.

Referring to FIG. 6*a*, a central U-slot 63*a* is formed in a forward direction in a central area of a radiation device 62. First auxiliary U-slots 63*b* are formed in a forward direction at both sides about the central U-slot 63*a*. Second auxiliary U-slots 63*c* are formed in a forward direction, and located next to each of the first auxiliary U-slots 63*b*.

The central U-slot 63*a* has a central point located on an extended line 64*a* of a feeding point of a radiation device, and is vertically symmetrical about the extended line 64*a*.

A pair of first auxiliary U-slots 63*b* are formed in a forward direction to oppose each other about the central U-slot 63*a*, respectively, preferably to be symmetrical about the extended line 64*a* of the feeding point of the radiation device.

A pair of second auxiliary U-slots 63*c* are formed in a forward direction next to each of the first auxiliary U-slots 63*b*, preferably to be symmetrical about the extended line 64*a* of the feeding point of the radiation device.

As described above, the U-slots have three pairs of symmetrical slot configurations about the extended line 64*a* of the feeding point of the radiation device, thereby ensuring an antenna with three notch filters, i.e., a quadruple band antenna.

Referring to FIG. 6*b*, the central U-slot 63*a* is formed in an inverse direction in such a fashion that a central point of the U-slot is located on the extended line 64*a* of the feeding point of the radiation device. A pair of the first auxiliary U-slots 63*b* are formed in an inverse direction to oppose each other about the central U-slot 63*a*. Also, a pair of the second auxiliary U-slots 63*c* are formed in an inverse direction next to each of the first auxiliary U-slots 63*b*, thereby achieving an antenna with triple notch filters.

Referring to FIG. 6*c*, the central U-slot 63*a* is formed in a forward direction in such a fashion that a central point of the U-slot is located on the extended line 64*a* of the feeding point of the radiation device. A pair of the first auxiliary U-slots 63*b* are formed in a forward direction to oppose each other about the central U-slot 63*a*. The second auxiliary U-slot 63*c* is disposed to surround the central U-slot 63*a* and the first auxiliary U-slots 63*b* from above.

Here, the central U-slot 63*a* and the second auxiliary U-slot 63*c* have a vertical symmetrical configuration about the extended line 64*a* of the feeding point. The first auxiliary U-slots 63*b* are symmetrical with each other about the central axis, i.e., the extended line 64*a*, achieving an antenna with triple notch filters.

Referring to FIG. 6*d*, the central U-slot 63*a* is formed in an inverse direction in such a fashion that a central point of the U-slot is located on the extended line 64*a* of the feeding point of the radiation device. A pair of first auxiliary U-slots 63*b* are formed in an inverse direction at both sides about the central U-slot 63*a*, respectively. Also, the second auxiliary U-slot 63*c* is disposed in an inverse direction to surround the central U-slot 63*a* and the first auxiliary U-slots 63*b*, ensuring an antenna with triple notch filters.

Referring to FIG. 6*e*, the central U-slot 63*a* is formed in a forward direction in such a fashion that a central point of the U-slot is located on the extended line 64*a* of the feeding point of the radiation device. The first auxiliary U-slot 63*b* is disposed in a forward direction to surround the central U-slot 63*a*. The first auxiliary U-slot 63*b* is formed lower than the central U-slot 63*a*, and has a central point located identical to that of the central U-slot 63*a*. Moreover, the second auxiliary U-slot 63*c* is disposed in an inverse direction to surround the central U-slot 63*b* and the first auxiliary U-slot 63*b* from above.

Here, the U-slots each have a symmetrical configuration about the central axis, i.e., the extended line 64*a* of the feeding point, thus achieving an antenna with triple notch filters.

Referring to FIG. 6*f*, the central U-slot 63*a* is formed in an inverse direction in such a fashion that a central point of the U-slot is located on the extended line 64*a* of the feeding point of the radiation device. The first auxiliary U-slot 63*b* is disposed in an inverse direction to surround the central U-slot 63*a*. The first auxiliary U-slot 63*b* is formed shorter than the central U-slot 63*a*, and has a central point located identical to that of the central U-slot 63*a*. Furthermore, the second auxiliary U-slot 63*c* is disposed in an inverse direction to surround the central U-slot 63*a* and the first auxiliary U-slot 63*b* from above. This enables an antenna with triple notch filters.

Referring to FIG. 6*g*, the central U-slot 63*a* is formed in a forward direction in such a fashion that a central point of the U-slot is located on the extension line 64*a* of the feeding point of the radiation device. The first auxiliary U-slot 63*b* is disposed in a forward direction to surround the central U-slot 63*a*. The first auxiliary U-slot 63*b* is formed lower than the central U-slot 63*a* and has a central point located identical to that of the central U-slot 63*a*. Also, the second auxiliary U-slot 63*c* is disposed in a forward direction to surround the central U-slot 63*a* and the first auxiliary U-slot 63*b*. The second auxiliary U-slot 63*c* is formed lower than the first auxiliary U-slot 63*b* and has a central point located identical to that of the first auxiliary U-slot 63*b*. This ensures an antenna with triple notch filters.

Referring to FIG. 6*h*, the central U-slot 63*a* is formed in an inverse direction in such a fashion that a central point of the U-slot is located on the extended line 64*a* of the feeding point of the radiation device. The first auxiliary U-slot 63*b* is disposed in an inverse direction to surround the central U-slot 63*a*. The first auxiliary U-slot 63*b* is formed shorter than the central U-slot 63*a* and has a central point located identical to that of the central U-slot 63*a*. Also, the second auxiliary U-slot 63*c* is disposed in an inverse direction to surround the first auxiliary U-slot 63*b*. The second auxiliary U-slot 63*c* is formed shorter than the first auxiliary U-slot 63*b* and has a central point located identical to that of the second auxiliary U-slot 63*c*, thereby realizing an antenna with triple notch filters.

Figure 8:
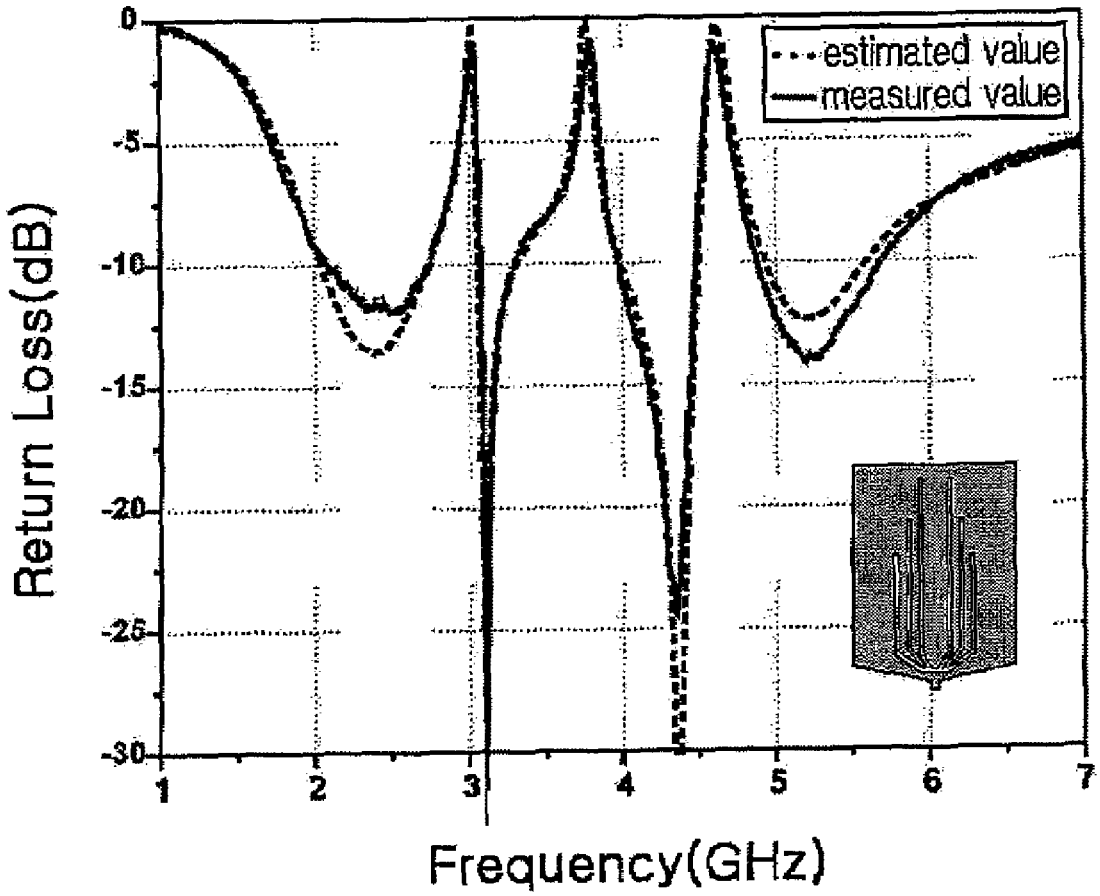
FIG. 8 is a graph illustrating return loss of a triple notch filter according to the invention.

FIG. 8 is a graph illustrating return loss of a radiation device including a coaxial cable as shown in FIG. 2 and U-slots as shown in FIG. 6*g*.

That is, at a return loss of 10 dB, four notch frequency bands are plotted at 2.0 GHz to 2.8 GHz, 3.1 GHz to 3.3 GHz, 4.0 GHz to 4.5 GHz, and 4.9 GHz to 5.7 GHz.

Here, the type, number and arrangement of U-slots can be variously modified in accordance with a necessary frequency band.

As set forth above, according to exemplary embodiments of the invention, a multi-band U-slot antenna can act as multiple notch filters depending on configuration and arrangement of U-slots formed in a planar radiation device. This allows transmission and reception of a multi-band frequency through a single antenna.

While the present invention has been shown and described in connection with the preferred embodiments, it will be apparent to those skilled in the art that modifications and variations can be made without departing from the spirit and scope of the invention as defined by the appended claims.

What is claimed is:

1. A multi-band U-slot planar antenna comprising:

a ground plane;

a connector having a ground terminal connected to the ground plane and a feeding terminal for feeding a signal; and a planar radiation device comprising:

a feeding point connected to the feeding terminal, a central U-slot having a symmetrical configuration about a central axis thereof, wherein the central axis extends through the feeding point, at least one auxiliary U-slot having a symmetrical configuration about the central axis; and a pair of second auxiliary U-slots symmetrical with each other about the central axis, wherein the planar radiation device is perpendicular to the ground plane.

2. The multi-band U-slot planar antenna according to claim 1, wherein said at least one auxiliary U-slot encompasses the central U-slot and said second auxiliary U-slots.

3. The multi-band U-slot planar antenna according to claim 2, wherein the central U-slot and the second auxiliary U-slots are open in a direction toward the feeding point.

4. The multi-band U-slot planar antenna according to claim 2, wherein the central U-slot and the second auxiliary U-slots are open in a direction away from the feeding point.

* * * * *

UNITED STATES PATENT AND TRADEMARK OFFICE

CERTIFICATE OF CORRECTION

PATENT NO. : 7,605,769 B2
APPLICATION NO. : 11/735868
DATED : October 20, 2009
INVENTOR(S) : Jae Chan Lee et al.

It is certified that error appears in the above-identified patent and that said Letters Patent is hereby corrected as shown below:

Title Page, Item (54) and at Column 1, line 1,

Title: "MULTI-BAN U-SLOT ANTENNA" should be --MULTI-BAND U-SLOT ANTENNA--

Signed and Sealed this

Twenty-ninth Day of December, 2009

David J. Kappos

David J. Kappos
*Director of the United States Patent and Trademark Office*